United States Patent [19]

Strnat

[11] 3,998,669

[45] Dec. 21, 1976

[54] PERMANENT MAGNET ON THE BASIS OF COBALT-RARE EARTH ALLOYS AND METHOD FOR ITS PRODUCTION

[75] Inventor: Karl Strnat, Fairborn, Ohio

[73] Assignee: Th. Goldschmidt AG, Essen, Germany

[22] Filed: Aug. 14, 1975

[21] Appl. No.: 604,534

Related U.S. Application Data

[63] Continuation-in-part of Ser. No. 507,868, Sept. 20, 1974, abandoned, which is a continuation of Ser. No. 397,313, Sept. 14, 1973, abandoned, which is a continuation of Ser. No. 207,867, Dec. 14, 1971, abandoned.

[52] U.S. Cl. ..... 148/31.57; 148/103; 148/105; 252/62.54

[51] Int. Cl.[2] ..... H01F 1/04

[58] Field of Search ..... 148/103, 105, 31.57; 264/DIG. 58; 29/180, 608; 252/62.54

[56] References Cited

UNITED STATES PATENTS

| | | | |
|---|---|---|---|
| 2,724,174 | 11/1955 | Mendelsohn | 29/180 R |
| 2,864,734 | 12/1958 | Adams et al. | 148/103 |
| 3,540,945 | 11/1970 | Strnat et al. | 148/31.57 |
| 3,596,350 | 8/1971 | Steingroever | 29/608 |
| 3,677,947 | 7/1972 | Ray et al. | 252/62.54 |
| 3,684,591 | 8/1972 | Martin | 148/31.57 |

*Primary Examiner*—Walter R. Satterfield
*Attorney, Agent, or Firm*—Toren, McGeady and Stanger

[57] ABSTRACT

A permanent magnet is disclosed which exhibits pronounced ductility combined with a mechanical strength satisfactory for many applications and which can be machined with conventional steel tools. The magnet is formed by compacting at least one magnetic powder comprising a cobalt-rare earth alloy admixed with a metallic binder. The binder is a solder of a melting point below 400° C and bonds the particles of the magnetic powder. Procedures for forming the novel magnets are also disclosed.

18 Claims, 5 Drawing Figures

DEMAGNETIZATION CURVES of MAGNET of EXAMPLE 11

PERMANENT MAGNET ON THE BASIS OF COBALT-RARE EARTH ALLOYS AND METHOD FOR ITS PRODUCTION

CROSS-REFERENCES TO RELATED PATENT APPLICATION

The application is a continuation-in-part of copending patent application Ser. No. 507,868, filed Sept. 20, 1974, and now abandoned, which in turn is a continuation of Ser. No. 397,313 filed Sept. 14, 1973, and now abandoned, which application was a continuation of patent application, Ser. No. 207,867 filed Dec. 14, 1971, and now abandoned.

BACKGROUND OF THE INVENTION

1. Field of the Invention

The invention relates to a cobalt rare-earth alloy for permanent magnets, and more particularly to a binder system for cobalt rare-earth permanent magnets.

2. Description of the prior art

A new class of materials exhibiting permanent-magnet properties has been introduced in the last few years. These materials are basically alloys containing approximately 10 to 25 atomic percent of rare-earth elements and 75–90 atomic percent cobalt, a part of which may be replaced by the elements manganese, iron and/or nickel. An additional alloy partner in these alloys can be copper. The materials may contain a single rare-earth element or a mixture of several rare-earth elements may be used.

From these alloys, which have high magnetocrystalline anisotrophy, permanent magnets can be produced in the following manner: The alloys are comminuted into powder form, binder material is added if desired, the powder mixture is exposed to a magnetic field, and the blend is then formed into a rigid magnet by pressing, sintering, or hardening of the binder. It is furthermore possible to achieve permanent-magnet behavior in the massive state by adding copper to the alloy and subjecting the latter to an appropriate heat treatment. In this case, the magnets with the best properties should in principle be castings of the alloy. In the case of powder-metallurgical magnet preparation from copper-free rare earth alloys, the best magnets are made by sintering or hotpressing to the highest possible density. In both cases the magnets have the disadvantage of poor mechanical properties. They are brittle and subject to internal cracking, and they either cannot be machined at all, or only by grinding or abrading.

The ferrite and Alnico materials, which are the permanent magnets predominantly used in technological applications at the present time, have the same disadvantages. An improvement of these mechanical properties is therefore desirable.

An Alnico system is seen, for example, in U.S. Pat. No. 2,724,174 to Mendelsohn, which discloses that moldable compositions can be prepared by coating finely-divided Alnico with a low melting point metal or alloy and producing intermetallic bonding. The product, which is obtained after a heating step in which the low temperature metal is melted, is still a powder which is suitable for subsequent forming into a magnet by the usual and previously known steps of magnetic aligning and compacting under pressure without adding any additional solder or binding material. The process applies to the magnetic materials family known as Alnico, the iron content of which appears to play an essential role in the successful formation of the soft-metal surface coating by the process described in the patent (see column 1, lines 65 through 69, and column 2, line 40).

Alnico is noted to be a solid solution alloy unlike the intermetallic compounds of the instant invention which are based on cobalt and substantial quantities of rare-earth metals. The Alnico alloys are based on iron and contain several other important constituents such as nickel and aluminum which are not normally present in cobalt rare-earth magnets. The rare-earth component of the cobalt rare-earth magnets is, of course, not found in Alnico magnets.

The composition differences between the Alnico and rare-earth cobalt magnets unfortunately render the Alnico technology inapplicable to the rare-earth cobalt magnets, at least on a direct and predictable basis. Along these lines, it is noted that the mechanism of bond formation in the Mendelsohn Alnico magent involves the formation of intermetallic compounds between the bonding metal and one or more of the constituents of the Alnico, probably the iron, a material not found in cobalt rare-earth magnets.

It is thus found that the availble technology has not served to overcome the problems of the commercially available magents made from rare-earth cobalt alloys by sintering. The magnets are inherently brittle intermetallic compounds and inevitably have high internal stresses and often microcracks from the quenching or rapid cooling, after sintering, which is necessary to develop high coercive force. They are especially sensitive to impact when dropped or allowed to snap against each other or onto iron parts under the strong forces of magnetic attraction. This is often a considerable disadvantage in the assembly of magnetic devices, as well as during machining and handling in general.

The sintered magnets are very hard and can only be machined by the methods used for hard ceramics, such as grinding or abrasive cutting, or by the slow and costly electric spark erosion technique. Sintered magnets, especially those of larger size, also often have nonuniform magnetic properties throughout their volume. This is especially true for the intrinsic coercive force and the loop squareness, both of which depend strongly on the cooling rate which can vary significantly within a magnet.

Conventional sintered ceramic magnets (barium or strontium ferrite) share many of the same disadvantages with the rare earth magnets, although their brittleness and susceptibility to breaking are not as extreme. Methods were devised of regrinding the ferrite material to a coarse powder and bonding the particles into a body of the desired shape, using an organic binder such as rubber, a phenolic resin, and the like, in order to solve the foregoing problems. The ferrites, being oxides, are quite insensitive to the exposure to elevated temperatures, oxygen and corrosive chemicals during processing, and to exposure to air and moisture during later use.

The ceramic magnet bonding methods may be applied to rare-earth-cobalt powders and produce magnets that are neither brittle nor sensitive to impact, that are more or less flexible, and that can easily be cut with normal steel tools. However, the disadvantages of such organic-bonded magnets are:

a. they are quite soft — their mechanical strength properties are determined by the binder and are insufficent for many purposes — small compressive or tensile stresses cause large elastic deformation or plastic flow;

b. the highest use temperature is determined by the chemical and structural stability of the binder-typical temperature limits are in the range of 60° to 130° C; and c. organic binders cannot prevent the slow but progressive loss of coercive force which is known to occur when unprotected rare-earth cobalt powders are aged in air.

IN THE DRAWINGS

SUMMARY OF INVENTION

Figure 1:
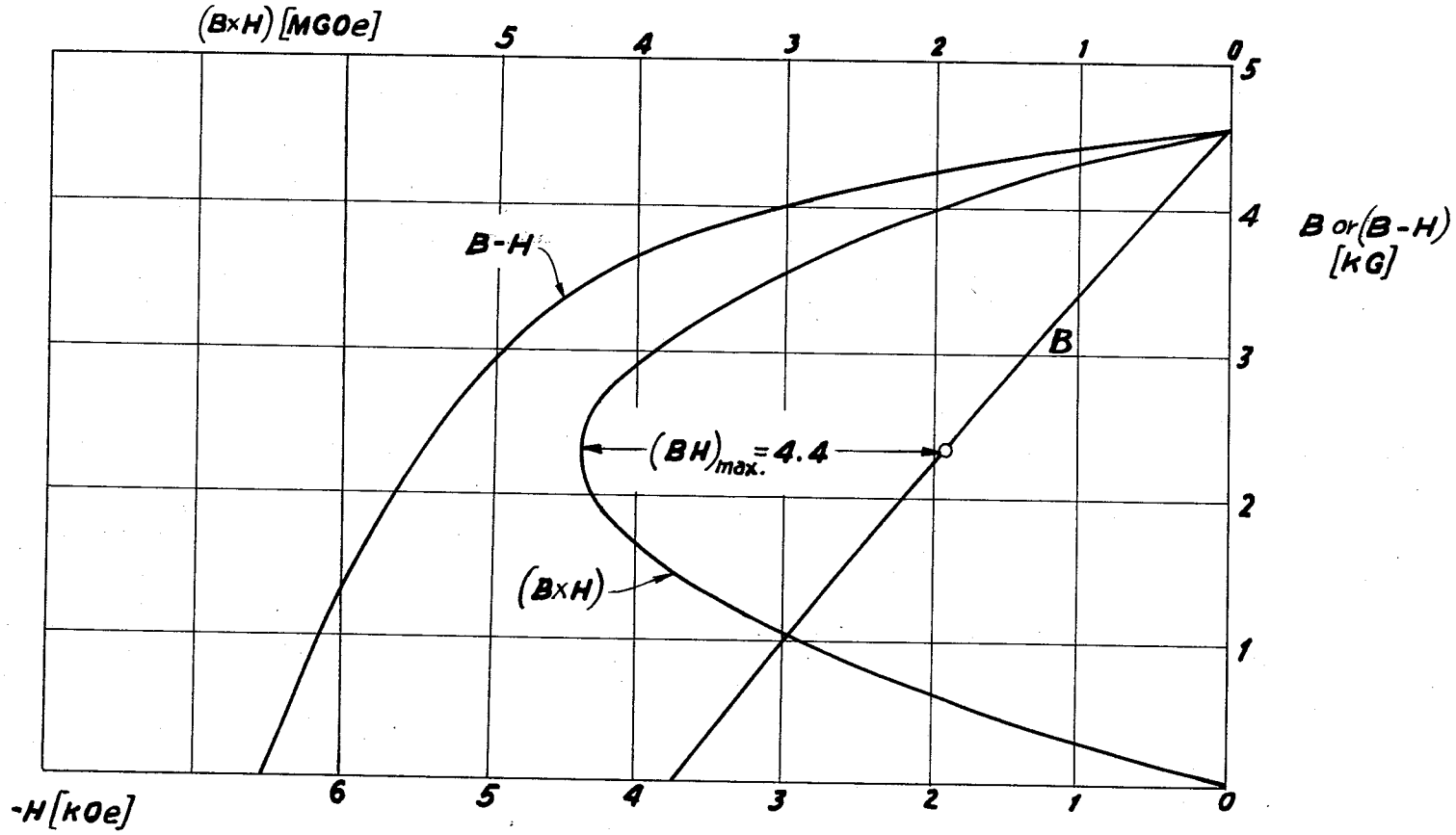
FIG. 1 depicts the demagnetization curves of magnets produced according to the procedure of Example 11.

It is a primary object of this invention to provide an improved procedure for the production of permanent magnets on the basis of cobalt rare-earth alloys, which may contain other alloy partners, which magnets can be easily formed and machined, are not brittle, and have a combination of mechanical and magnetic properties which ensures their broad applicability.

The above objects are superiorly attained in accordance with the invention by adapting the following procedure which, in its simplest form, comprises the following steps:

a. Blending the pulverized cobalt rare-earth alloys with at least 9 weight % of a powdered metal or solder alloy which has a melting point below 400° C;

b. introducing the mixture into a pressing mold with the lowest-density packing possible;

c. applying a magnetic field of sufficient strength to align the particles, if desired;

d. compacting the mixture by the application of pressure;

e. heating of the powder compact to a temperature above the melting point or in the melting range of the solder and subsequently cooling the compact to room temperature.

The procedural steps d) and e) may be combined in one, that is, one can "warm press", or sinter under pressure. If this is done, pressure and temperature may be raised to the desired levels either simultaneously or one after the other in either sequence. The advantage of this method is that the temperature necessary to achieve a good bond is reduced somewhat and may even lie in the "mushy" temperature range of the solder. Another advantage is that a better densification of the mixture, and consequently a lower degree of porosity of the magnet body, is achieved.

In another modification of the inventive method, the powder mass can be heated before the magnetic orienting field is applied. The pressing step then follows the application of the field. This can be advantageous with powders of extremely high coercive force, because at elevated temperatures these can be saturated in a lower magnetic field than that needed to achieve magnetic saturation at room temperature. A higher degree of saturation of the particles, however, facilitate their orientation by means of a magnetic field of given strength.

Useful in the invention, are the rare earth-transition metal alloys containing 10–25 atomic % of rare-earth component. The rare-earth can be one or more of the elements Y, Sc, La, Ce, Pr, Nd, Sm, Eu, Gd, Tb, Dy, Ho, Er, Tm, Yb, and Lu, but preferably, Y, La, Ce, Pr, Nd, Sm, Gd, Dy, Ho, and Er.

The 75–90 atomic % balance of the alloy consists of Co alone, or of Co plus up to 50 atomic % of at least one metal selected from the group consisting of Fe, Mn and Ni. The alloys are used in the form of powders of a particle size between 1 and 50 $\mu$ and can be coated with a metallic surface layer, typically Sn, Zn or As, which has been diffused into the particle surface by heating the coated particles.

The rare-earth transition metal alloys can also contain Cu, in an amount up to 50 atomic % of the transition metal, or Cu and at least one metal selected from the group consisting of Fe, Mn and Ni. Most preferably, the rare-earth is Ce, Sm or the rare-earth mixture cerium-rich mischmetal (MM) which consists essentially of 50 to 60 % cerium, remainder lanthanum and other rare earth metals. These alloys are heat treated to develop magnetic hardness by precipitation of a finely distributed metallurgical phase and being used in the form of particles in the size range of about 20 to 250 $\mu$m.

The grain size for particular alloy compositions can be defined in narrower limits as soon as one chooses a particular alloy composition. For instance, the grain size for the alloy $SmCo_5$ can be near the upper limit of the range (<50 $\mu$m) and still yield a useful coercive force. Finer grain sizes may, however, be used. For $YCo_5$, or $CeCo_5$ or $MMCo_5$, grain sizes below several $\mu$m, i.e. near the lower limit of the previously defined range, are needed. The maximum grain size for $PrCo_5$ — another important alloy — lies in the middle of the range, between approximately 10 and 20 $\mu$m. It must be kept in mind that for any given alloy the coercive force is generally the higher the smaller the particles are. However, the coercive force can also be influenced by heat treatment or chemical surface treatment of the powder in a way that is complex and not yet fully understood. Consequently, is is not possible to make more precise statements about the grain size.

For the copper-containing alloys, the grain size is less important, since the coercive force does not primarily depend on it. It may be determined by the requirement for densest particle packing or by other manufacturing considerations. The particle size for these alloys may be up to 100 $\mu$m or even more. Generally, in the production of anisotropic magnets, the grain size in the ingots to be crushed should be larger than the average desired particle diameter because most of the particles should be single crystals so that they can be well aligned by the magnetic field applied before the compaction.

The metals used as the binder are the so-called "soft solders" with melting points below 400° C, and are preferably used in the range of from 9 to 25 % by weight. it is noted that some binders, such as pure Sn, pure Pb, or the eutectic Sn - Pb alloy solder, melt at a single, well defined temperature which one must exceed in the magnet fabrication. However, more typically, solder alloys soften slowly and exhibit a mush consistency over a substantial temperature during the heating operation. Thus, in general, the heating step must be carried out at a temperature in or above the melting range, and preferably in the range from 190° to about 260° C, but temperatures up to 400° C can be used. The following are examples of such solder metals;

1. Commercial tin-lead solders with a tin content between approximately 40 and 70 weight %. Especially well suited are the near - eutectic solders of approximately 60 to 65% tin because of their low liquidus temperature. For the latter, the best temperature range in which a good bond can be obtained by the described method without the simultaneous application of pressure, is between 190° and 260° C. Also usable are tin-lead base solders which are modified by small additions of indium, silver, antimony or bismuth.

2. Pure tin (melting point $t_m = 232°$ C) or tin modified by the addition of a few percent of silver, antimony or indium. These metals have somewhat higher melting points than the tin-lead solders (220° to 240° C). They exhibit better corrosion resistance and have comparable mechanical strength, but they are also more expensive.

3. Pure lead ($t_m = 325°$ C) or lead modified with small additions of tin, silver, antimony or indium ($t_m =$ 280° to 335° C). Such lead solders are cheaper than the tin-base solders, but they yield a less satisfactory bond and are also less corrosion resistant. The temperatures needed to achieve a satisfactory bond of the magnet body with these solder alloys lie again above the melting or liquidus temperature, and they come dangerously close to those temperatures needed for the magnetic hardening of the copper-containing magnet alloys. Therefore, if such alloys are to be bonded with lead-base solders, rapid work and a precise control of temperature and treatment time during the bonding is required.

4. The commercially available indium-rich solders may in principle also be used. Examples for these are:

a. An alloy of 50% In and 50% Sn which melts at 117° C and gives a good bond already at temperatures between 120° and 180° C.

b. An alloy of 25% In, 37.5% Sn, and 37.5% Pb which melts at 138° C.

c. Indium-lead solder with 20% In, melting point $t_m =$ 157° C.

d. Indium-lead solder with 50% In, $t_m = 216°$ C.

e. Indium-silver solder with 90% In, 10% Ag, $t_m =$ 232° C.

f. Pure indium with $t_m = 157°$ C.

The indium-rich solders are appreciably more expensive than the Sn-Pb solders, their mechanical strength is lower and so is their melting temperature. Although the two latter properties may bring advantages in production, they also influence the temperature behavior of the finished magnet in a manner that is often undesirable, and the use of these solders is thus restricted to exceptional cases. (The alloy of 50% In and 50% Pb is a favorable exception: it behaves similar to Sn-Pb solder, although it is considerably more expensive.)

5. Very low-melting solders with a high content of bismuth may in principle also be used. Because of their very low melting point of 50 to 100° C they have, however, little practical significance. However, they can be used to advantage in laboratory experiments with various mixtures of magnetic powders because they allow convenient bonding and, if desired, magnetic orientation of the particles at only moderately elevated temperatures. An example for such a solder alloy is Wood's metal with 12.5% Sn, 25% Pb, 50% Bi and 12.5% Cd, which is completely liquid at 74° C.

The magnetic alloy powders used for the production of the magnets can have a uniform chemical composition, that is, one can, for instance, use any of the alloys $SmCo_5$, $PrCo_5$ and $MMCo_5$ alone, also magnetically precipitation-hardened $CeCo_{3.5}CuFe_{0.5}$, $MMCo_3Cu_2$ or any other of the large variety of rare-earth cobalt-base alloys which are in principle useable for permanent magnets. It is also possible, however, to use a powder which is a blend of several such alloys. In this case, the chemically different components of the powder may have identical or different grain sizes, or they may have a particle-size distribution with a single narrow or one with a broad maximum, or even a distribution with several maxima. The particle size and size distribution is immaterial for the principle of bonding by "internal soldering" with which the inventive procedure is concerned. However, it is necessary to fulfill the previously discussed magnetic conditions in the choice of particle size, and the particle size distribution can also influence the packing density of magnetic material which can be achieved and, consequently, the possible remanent magnetization values of the resulting magnets. The manner in which one can optimize the magnetic remanence and, consequently, the energy product by prudent choice of several magnet alloys and different particle size fractions is disclosed in the U.S. Pat. No. 3,677,947.

Again for reasons of optimum packing of the particles, and in order to achieve the best possible dispersion of the binder in the mass of magnetic powder to be bonded, the average particle size of the solder powder should be chosen substantially smaller than the average particle size of the magnetic powder. For the same reasons it is advantageous to choose a solder powder with rather uniform grain size distribution. Especially, it should not contain an appreciable amount of very coarse particles.

As the next step in the preparation of the magnets, the powder of the magnetic alloy or alloys and the powder of the metallic binder (solder) and, if used, also solder-flux powder, are intimately blended by stirring, shaking or kneading. Either can be done dry or wet, and if a liquid solder flux is used, it may be utilized to moisten the powder mass. It is often also advantageous to premagnetize the mixture in a magnetic field whose strength exceeds the coercive force of the magnetically hardest component of the powder before introducing it into the pressing mold. This causes the particles to be nearly completely saturated parallel to their magnetic easy axis, so that they can subsequently be more readily aligned by means of a lower orienting field than the field required when the particles are not thus presaturated.

The powder mixture so prepared is now introduced into a pressing mold. If the magnetically active particles in the mixture are to be oriented relative to one another by applying a magnetic field of proper strength, it is essential that the powder mixture is introduced into the pressing mold with a minimum of densification, so that the orientation of the particles can proceed with a minimum of mutual interference. The aligning of the particles may be facilitated by mechanical vibration, by switching the magnetic field on an off repeatedly, or by superimposing an electromagnetic alternating field over the steady alignment field. A liquid may also be added which will act as a lubricant and reduce the friction between the particles. It is, however, not absolutely necessary in the production of permanent magnets that a magnetic field be applied which aligns the particles. Permanent magnets may also be produced without such an orientation of the particles, but they are of lower quality. If the production of anisotropic magnets is intended, it is advantageous to restrict the compaction in the magnetic field to a pre-pressing step in which only moderate forces need be used. This pre-pressing fixes the particles in their oriented position, and no magnetic field has to be applied in the subsequent final pressing step which produces the desired high density. This makes possible the application of common pressing tools designed for uniaxial or hydrostatic pressure.

If the particles are not to be oriented in a magnetic field, it is not necessary to maintain the lowest possible packing density in the pressing mold. A magnet produced in this manner has significantly inferior magnetic properties ($B_r$, $BH_{max}$) when compared to an oriented one. In some applications, however, this is accepted because the simplification of the production method also brings a cost reduction. In other cases, an isotropic magnet of this kind produced without an orienting field is even preferred because its use may simplify the design of the magnetic circuit, This situation is strictly analogous to that existing with the ferrites.

The next production step is to apply a force and thus compact the mixture in the pressing mold. This pressing step produces the desired external shape of the permanent magnets. After this, the powder compact is heated to a temperature above the melting range of the solder and subsequently cooled to room temperature. The magnetizing field can be applied while the compact is still hot from the soldering step, thus lowering the field strength required and consequently lowering the cost of operation.

A permanent magnet produced in this manner can be further shaped by conventional machining operations such as milling, sawing, drilling, turning on a lathe, all with conventional steel tools. It is furthermore possible to attach fasteners, mounting devices, electrical or other connections by soldering directly to the surface of such a magnet. This makes it possible to adapt the magnet simply to its intended application and simplifies construction of the device that incorporates the magnet. It is also possible to assemble larger magnets from small ones or to construct complex magnetic circuits by soldering magnets to one another or to mild-steel pole pieces, etc., as is well known in the art.

In order to achieve the highest possible packing density of the magnetic component in the finished magnet, it is especially advantageous to use several grain-size fractions of the magnetic material which have different average particle size while each fraction has a narrow grain size distribution. These fractions can either be of the same magnetic material, or several different rare-earth alloys may be used. As an example, one may choose a precipitation-hardened, copper-containing rare-earth cobalt alloy for the coarsest fraction and a powder of a pure rare-earth cobalt alloy as the second, finer fraction, whereby the particles of the latter may also be surface-metallized in order to improve their chemical stability and the wettability by the molten solder. The latter procedure has previously been demonstrated by Luborsky for single-domain iron particle magnets. The third powder fraction with the finest particle size is the solder.

The wetting of the finely powdered cobalt rare-earth alloy particles by the molten solder, and therefore the quality of the bond between the two, can be improved by adding a soldering flux to the mixture before it is heated. By way of example, a powdered solid flux may be added to the blend of the cobalt rare-earth alloys and the solder. One may also use a liquid flux, and one way of introducing the latter is by soaking the compact in the liquid before heating. Such a liquid flux may also be added to the blend prior to the pressing step and can then improve the alignment of the particles in the magnetic field by acting as a lubricant as was previously explained. As a third alternative, either the powder blend or the compact may be exposed to the action of a gaseous flux.

Applicable solid fluxes are finely-powdered tin chloride or zinc chloride. These solid fluxes may also be applied in the form of a liquid solution which is added to the powder mixture. In this case, the solvent is to be vaporized either before or after the pressing step by reducing the gas pressure above the sample (by evacuating). If this is done, the flux is deposited in a solid but extremely finely distributed form on the surface of the metal particles to be bonded.

Applicable liquid fluxes are tin or zinc chloride, aniline hydrochloride, hydrazine hydrochloride, or hydrazine hydrobromide, all in either an aqueous solution or in an appropriately chosen organic solvent.

Useful gaseous fluxes are hydrogen gas or dry HCl gas. These gaseous fluxes are preferred to the solid or liquid fluxes, because they do not leave residues which may cause corrosion of the magnets.

Such gaseous fluxes may be introduced in the finished porous metallic powder compact which previously has been produced by pressing in air. To do this, the compact is placed in a container that is evacuated and subsequently backfilled with the flux gas. This replaces most of the air contained in the pores by the gas. The subsequent heating of the compact is preferably done in an atmosphere of the same gas. However, the compact soaked with the flux gas in this manner can also be transferred into a furnace chamber filled with hydrogen gas, a noble gas or even nitrogen or air in order to be heated for the soldering step, or it may be immersed in a molten salt bath. If the sample is thus transferred into a different atmosphere, it is essential to work very rapidly in order to prevent a loss of the flux gas from the porous body by diffusion. It is also feasible to introduce the flux gas into an evacuable pressing mold before the compaction, or alternatively the mixing and handling of the loose powder prior to pressing may already be accomplished in an atmosphere of the gaseous flux, for instance in a hydrogen atmosphere. The latter procedure is recommended when one of the powder fractions consists of particles so fine that they tend to be pyrophoric.

Permanent magnets produced according to the method of this invention have a very dense structure and they are well protected by the solder used in bonding against mechanical damage and atmospheric attack. Additional corrosion protection and mechanical strengthening may be achieved by immersing the finished magnet or the powder compact in liquid solder subsequent to the pressing or heating steps. This procedure produces an especially dense surface layer.

The invention will now be described by several Examples, it being understood that these Examples are given by way of illustration and not by way of limitation and that many changes may be made without departing in any way from the spirit and scope of this invention as recited in the appended claims.

EXAMPLE 1. - PREPARATION OF THE ALLOYS

The magnetic constituents used in the preparation of the various magnets described in the following examples had the compositions $SmCo_5$, $PrCo_5$, $MMCo_5$, $MMCo_3Cu_2$ and $SmCo_{3.5}CuFe_{0.5}$. "MM" stands for mischmetal. The term "mischmetal", as used herein, designates a mixture of the light rare-earth metals dominated by cerium and lanthanum. The mischmetal used in the experiments described herein was the product "Ceralloy 100X" of the Ronson Metals Corporation with the approximate composition: 55% by weight Ce, 26% La, 13% Nd, 5% Pr, 0.5% Y.

The binder metals used were either pure tin, or a tin-lead solder alloy or Wood's metal. This first example describes briefly the general procedure used in preparing these alloys, converting them into powder, and extracting the desired particle size fraction from these powders. All of these procedures are indeed within the state of the art and have been described previously in publications and patent applications. The procedures used in these preliminary steps are described herein for the sake of completeness. It must be kept in mind that there are several alternative and equivalent procedures for alloy and powder preparation.

The alloys used in the experiments described herein were generally prepared by melting together the elemental metallic ingredients. Metallic samarium, or praseodymium, or mischmetal and the transition metal partners cobalt and copper, where applicable, were weighed out in the proportions corresponding to the formulas given above. This shall be illustrated with two examples.

a. To prepare an ingot of $SmCo_5$ of 1 kg weight, 338.5 g Sm and 661.5 g cobalt--both in the form of approximately pea-size small pieces--were mixed and inserted into an alumina crucible and then melted in an induction furnace at approximately 1450° C. During cooling, the ingot was held for 1/2 hour at the temperature of 1200° C to achieve homogenization.

b. In the preparation of the alloy $MMCo_3Cu_2$, the mischmetal, cobalt and copper were weighed out in the proportions corresponding to the formula to make a batch weighing approximately 50 g. The metals were melted in an arc-melting furnace with a water-cooled tungsten electrode under a protective gas mixture of 75% argon and 25% helium. The button-shaped ingots were turned over and remelted 3 times to achieve good homogenization. Five such ingots were prepared under the same conditions and were then broken into small pieces. The pieces were blended and heat-treated in vacuum for 4 hours at 500° C to develop a nonmagnetic precipitate to the proper particle size and distribution in the magnetic matrix to achieve optimum magnetic properties.

EXAMPLE 2. - PREPARATION OF THE POWDERS

Powders were then prepared and the desired particle size fractions were extracted in the following manner: The alloys were ground with mortar and pestle, and powder fractions of the following ranges of particle size were prepared by sifting with the aid of nonmagnetic wire screens and a sieve shaker:

< 37 μm, 37 to 53 μm, 53 to 74 μm, 74 to 105 μm, 105 to 149 μm and 149 to 250 μm A portion of the powder having <37 μm particle size was further ground in a ballmill and then sifted through a copper screen with openings of 20 μm, first by shaking, then by brushing, so that 2 particle fractions of 20 to 37 μm and <20 μm were obtained.

In the case of the precipitation-hardened alloy $MMCo_3Cu_2$, another method was used to obtain the finest grain sizes. Again, a fraction of less than 37 μm was first prepared by mortar grinding and sifting, but the finer fractions were produced by letting this powder run twice through a centrifugal classifier (Bahco Micro-Particle Classifier of the H. W. Dietert Company, Detroit, Michigan). In this manner, 3 additional fractions were obtained with mean particle diameters near 28, 18 and 10 μm according to microscopic observations.

Finer fractions of <20 μm, <10 μm and <4 μm particle size of the binder powders tin and Sn-Pb solder were also prepared by means of the centrifugal classifier as described above. The starting material in this case were powders of <63 μm particle size obtained from the Th. Goldschmidt AG, Essen, Germany.

In some cases, magnetic powders were used which were improved by coating the particle surfaces with either zinc or tin. Such treatment increases the initial coercive force and protects the particles against a loss of coercivity by ageing during processing or storage. An additional benefit lies in the fact that the wetting of the particle surfaces by the solder during the heating of the compacts is improved.

The procedure of coating particles with zinc was as follows: The powders were intimately mixed with 5 weight % zinc dust and the mixture was heated in vacuum to 450° C for a period of 10 minutes. A powder of $MMCo_5$ of less than 20 μm particle size treated in this manner had an intrinsic coercive force of ${}_MH_c = 2700$ Oe.

In the cases in which a tin coating was applied to the particle surfaces, this was achieved by subjecting powder of <50 μm particle size to electrolysis in a solution of $SnCl_2$ and sodium tartrate in water to which enough $H_2SO_4$ was added to attain a pH value of 2.8. The alloy powder was used as the cathode and very pure tin as the anode. When this electrolysis was carried out on two grams of $MMCo_5$ (See Examples 3–10) at room temperature for 3–½ hours, using a current of .08 amps, a final tin content of 1.4% of the total powder weight was obtained. This coated powder was then subjected to a vacuum heat treatment of 10 minutes at a temperature of 450° C. After this treatment, the powder was separated into a size fraction of 37 to 50 μm, which had an intrinsic force of 604 Oe, and one of less than 37 μm. A small quantity of material less than 20 μm was extracted from the latter fraction and it had 2000 Oe coercivity.

EXAMPLE 3. - BONDING OF $MMCo_5$ POWDER WITH PURE TIN $MMCo_5$ powder in the particle size range of 37 to 50 μm electrolytically coated with tin as described above and diffusion heat treated, was blended with tin powder of a particle size of less than 37 μm. The relative quantities of these two powders used were 80 weight % and 20 weight %, respectively. These powders were intimately mixed by stirring and shaking and were then compacted in a specially constructed pressing mold into magnet samples of prismatic shape (bricks) of the dimensions ¼ × ¼ × ¾ inches. Pressing mold and pistons consisted essentially of a non-magnetic and surface-hardened copper-beryllium alloy, and the construction of the pressing die permitted the application of a magnetic aligning field of approximately 36 kOe parallel to one of the short directions of the sample with the aid of a laboratory electromagnet. The pressing mold could be evacuated and backfilled with gas as desired. The powder mixture was introduced into the mold in such a way that it was kept at a very low density, the magnetic field was turned on, off, and on again several times, the mold was then evacuated in the presence of the field and a pressure of approximately 50,000 psi was applied for a time of 1 minute in the short direction of the brick perpendicular to the magnetic field. The result was a magnet having a packing density of the magnetic component $MMCo_5$ of 61%, a residual magnetization of 3700 gauss and an intrinsic coercive force of 590 Oe. (It must be noted that a very coarse-grained and, consequently, low-coercivity fraction of the inexpensive but relatively inferior material mischmetal-cobalt, was chosen as model and substance to be used in the initial experiments for demonstrating the feasibility of the new production method.) A magnet prepared in this manner has good cohesion and reasonable mechanical strength, so that it can be handled without particular precautions. For some applications, a greater mechanical strength is desired. This can be achieved by a subsequent heat-treatment which accomplishes an internal soldering and consequently a better bonding of the magnetic brick.

The magnetic brick was introduced into a quartz tube which was evacuated by means of a mechanical vacuum pump to a vacuum of $10^{-1}$ Torr (mm Hg) and then heated to a temperature of 280° C for a period of 5 minutes. The resulting magnet has substantially improved mechanical strength. This is obviously due to the fact that the tin fuses into a coherent network and bonds to the particles. Microscopic inspection of a metallographically polished section of this sample confirmed this, but it also revealed that good bonding had taken place only in a portion of the material.

EXAMPLE 4. - BONDING OF $MMCo_5$ POWDER WITH WOOD'S METAL

In the course of experiments to evaluate the bonding which can be achieved with various low-melting metal binders, the same tin-coated powder of $MMCo_5$ (particle size range 37 to 50 $\mu$m) was next consolidated into a solid magnet body with the aid of the low-melting alloy known as Wood's metal. A small porcelain mortar was preheated on a hot plate to approximately 150° C, 5 grams of Wood's metal chips were introduced into this mortar and melted, 15 grams of the tin-coated $MMCo_5$ particles were introduced, and the two components were thoroughly blended by kneading for several minutes with a porcelain pestle which had also been preheated. The above described pressing mold was also preheated to approximately the same temperature, the mix was introduced into the mold cavity, and the sample was compacted with a pressure of approximately 20,000 psi which was again maintained for a period of 1 minute. No magnetic field was used, since the objective of the test was merely to see if a satisfactory bond could be achieved, rather than to produce a magnet of optimum properties. After cooling to room temperature, the sample was ejected from the mold and again judged with respect to cohesion, mechanical strength, and - under the microscope - the uniformity and quality of the bonding between matrix and particles. The sample had good physical integrity, corners and edges were true to the mold shape and did not break off or crumble easily. The sample could be cut with a knife. Inspection of a polished cross-section under the microscope showed that the Wood's metal had formed into a coherent network surrounding the magnetic particles and that wetting of the $MMCo_5$ surfaces appeared to be good and uniform throughout the sample.

EXAMPLE 5. - BONDING OF $MMCo_5$ POWDER WITH A NEAR-EUTECTIC TIN-LEAD SOLDER

An attempt was made to bond the same kind of electrolytically tin-coated $MMCo_5$ particles used in Examples 3 and 4 with the aid of a tin-lead solder of the composition 60% Sn/40% Pb. The procedure used was essentially the same as that described in Example 3, except that a powder of the solder alloy having a particle size of <20 $\mu$m was substituted for the tin powder previously used. A higher pressure, namely 126,000 psi, was aplied during the pressing in the presence of a field of 36 kOe. The resulting magnet resembled the one produced in the initial step of Example 3 very closely in every respect.

Next, the brick sample was again introduced into a quartz tube which was evacuated to $10^{-1}$ Torr and then slowly heated to a temperature of 260° C and kept at that temperature for a period of 5 minutes. The sample was then allowed to cool to room temperature while the vacuum was maintained. The resulting magnet had again appreciably higher mechanical strength and better general physical integrity than before the internal soldering step and it had a more perfect shape and smoother surfaces than the magnet produced with pure tin as the binder. Microscopic inspection of a cross-section revealed that the binder had again only incompletely wetted the magnetic powder, forming islands where the matrix completely surrounded a group of particles which were isolated from one another and embedded in regions where the soldering was obviously incomplete and many small voids were evident in the composite.

EXAMPLE 6 - IMPROVED BONDING WITH Sn-Pb SOLDER THROUGH THE USE OF A LIQUID FLUX

Another brick sample was produced exactly as described in the first paragraph of Example 5. Before the heating step, however, the sample was immersed in a common neutral liquid soldering flux, to wit an aqueous solution of zinc chloride, for a period of several minutes. Subsequently, the sample was heated to 260° C in a quartz tube, this time under the protection of an argon gas atmosphere. After cooling to room temperature, a cross-section of the sample was prepared and inspected under the microscope. It was evident that in a surface layer approximately 1 mm thick, the wetting of the particles by the solder and the coalescing of the solder particles into a coherent matrix was much improved. The sample thus had a mechanically very strong shell which made it considerably more rugged than any of the other previously produced samples. The interior of the sample had the same appearance of incomplete wetting and bonding as was observed before. The physical dimensions of the sample had not changed measurably during the heat treatment. The magnetic properties of a sample prepared in this manner were as follows:

Residual induction 3000 gauss, intrinsic coercive force 550 Oe.

EXAMPLE 7. - UNIFORM BONDING WITH Sn-Pb SOLDER BY IMPROVED IMPREGNATION WITH A LIQUID FLUX

Uniform bonding throughout the entire sample was achieved by the following modification of the procedure of Example 6:

After the pressing step, the sample was again impregnated with the liquid soldering flux for a period of several minutes, but the impregnation was aided by a vacuum. The dish containing the flux and the immersed sample was put in a vacuum desiccator and the space above the sample and liquid was evacuated with a mechanical pump. After several minutes the desiccator was opened to the atmosphere, the sample was extracted from the liquid, and it was then vacuum dried for another ½ hour to allow the solvent of the flux to evaporate. Next, the sample was transferred into a quartz vial and heated to 270° C for 10 minutes. Microscopic inspection of the resulting body showed that the solder had melted uniformly throughout the entire sample and had wetted and bonded to the magnetic particles, closing substantially all pores, in the same manner that was observed for the thin outer shell only in Example 6. This magnet is mechanically strong and is completely impervious to liquids and atmospheric gases. The external dimensions and magnetic properties of the sample were again substantially the same as in Example 3 and were essentially unaffected by the heat treatment.

EXAMPLE 8. - USE OF A SOLID FLUX

A brick magnet sample was prepared principally as described in Example 5, with the only exception that 0.5% of a solid flux was added to the mixture of the $MMCo_5$ powder and the Sn-Pb solder powder. Anhydrous tin chloride was ground into a fine powder using mortar and pestle, weighed out and blended with the metal-powder mixture. The compact was again heated in a protective atmosphere of argon gas of 1 atm pressure to a temperature of 270° C for 10 minutes. Microscopic inspection showed the magnet particles to be fairly uniformly wetted and bonded throughout the volume of the sample, although the structure was slightly less perfect than that obtained by the procedure of Example 7.

EXAMPLE 9. - USE OF A GASEOUS FLUX

Another powder compact was prepared exactly as described in the first paragraph of Example 5. It was introduced into the quartz heat treating tube. The tube was evacuated by the mechanical pump and the sample was allowed to outgas for one hour. Then, the annealing tube was backfilled to a pressure of one atmosphere with dry hydrogen gas. The sample was heated to 270° C for 10 minutes and it was then allowed to cool in the hydrogen atmosphere. Microscopic inspection of a sample cross-section showed that excellent wetting and bonding of the magnetic particles by the solder had taken place. The body was substantially equivalent to the one obtained by the procedure of Example 7.

EXAMPLE 10. - PREPARATION OF A MAGNET FROM TWO PARTICLE SIZE FRACTIONS OF A MAGNETIC POWDER

Next, an attempt was made to apply the optimum procedure for internal soldering with a liquid flux to a blend of two different size fractions of one and the same magnetic material, a procedure which should yield an improved packing density and consequently higher residual magnetization and energy product. The magnetic component used was again $MMCo_5$. The two powder fractions used were: the fraction of 37 to 50 μm, coated with tin, as used in all previous examples; and a fraction of less than 20 μm particles which had been coated with 5% zinc and heat treated as described in Example 2. Seven parts by weight of the coarse $MMCo_5$ fraction, three parts by weight of the fine $MMCo_5$ fraction and one part of a Sn-Pb solder powder having particle diameters of <10 μm were intimately blended and pressed into brick samples as described in Example 5. The sample was then vacuum-impregnated with the liquid soldering flux as in Example 7 and heat treated in the manner described therein. A magnet resulted which had excellent physical integrity, the same dimensions as immediately after the pressing step, and the following magnetic data:

$B_r = 4200$ gauss, ${}_MH_c = 2400$ Oe, $BH_{max} = 3$ MGOe

EXAMPLE 11. - PREPARATION OF A MAGNET FROM TWO DIFFERENT MAGNETIC MATERIALS BASED ON Sm-Co.

A blend of two magnetic powders in the weight ratio of $a : b = 7 : 3$ was prepared from the following materials:

a. $SmCo_{3.5}CuFe_{0.5}$, heat-treated 4 hrs. at 475° C, 74–105 μm particle size b. $SmCo_5$, treated with 5% Zn at 450° C, <37 μm particle size 4 grams of this blend were intimately mixed with 1 gram of Sn-Pb eutectic solder powder of <10 μ particle size. The powder mixture was then immersed in an aqueous tin chloride solution, the liquid filtered off and the powder vacuum dried at room temperature. A brick-shaped magnet sample was pressed from the dry powder following the procedure described in Example 3, and its magnetic properties were measured in a magnetizing field of 22 kOe. This compact was then heated in vacuum to 280° C and was kept at this temperature for 8 minutes. The properties were measured again after cooling to room temperature. The results are shown in the table, the demagnetization curves of the sample in its final state in FIG. 1.

| | ${}_MH_c$(Oe) | ${}_BH_c$(Oe) | $B_r$(G) | $BH_{max}$(MGOe) |
|---|---|---|---|---|
| After pressing | 6890 | 3940 | 4620 | 4.6 |
| After heating | 6540 | 3750 | 4566 | 4.4 |

In attempts to machine this magnet it proved easy to drill a hole with a normal tool-steel drill, it could be cut with a fine-toothed metal saw blade and machined by turning it on a lathe. It was possible to solder copper and steel wires to the surface of the magnet using an 80 watt electric soldering iron and 60% Sn/40% Pb resin-core wire solder. Finally, the magnet was dipped briefly into a bath of molten solder of the same type. This left it uniformly covered with a smooth coating of the soft solder alloy which seals the magnet completely against penetration by liquids, gases or atmospheric moisture, thus providing additional corrosion resistance and stability.

EXAMPLE 12. - PREPARATION OF A MAGNET FROM TWO DIFFERENT MAGNETIC MATERIALS BASED ON MM-Co AND Pr-Co.

The following powders were blended in the weight ratio $a : b : c = 6 : 2 : 1$.

a. $MMCo_3Cu_2$, heat-treated 3 hours at 500° C, 53–74 μm particle size b. $PrCo_5$, treated with 3% Zn at 450° C, 10–20 μm particle size c. Solder, 60% Sn/40% Pb, <4 μ particle size The loose powder mixture was premagnetized in a magnetic field of ~ 26 kOe strength. It was then transferred into the brick mold and compacted at 50,000 psi. Before compaction, an aligning field of only 10 kOe was applied, the mold was evacuated by means of a mechanical pump and backfilled with hydrogen gas.

Figure 2:
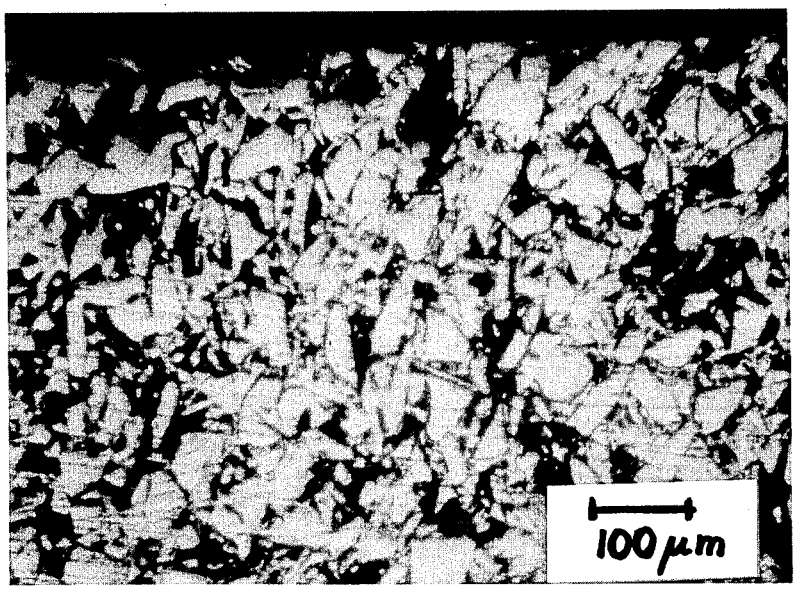
FIG. 2 is a metallographic cross-section of an internally soldered magnet made as described in Example 12.

The compact was then heated to 250° C in an oven with a nitrogen atmosphere and kept at temperature for 15 minutes. A metallographic cross-section (100X) of this magnet is shown in FIG. 2.

The resulting magnet had good mechanical integrity, a Rockwell C hardness of $R_c = 40$, measured on the surface, and the following magnetic properties: ${}_MH_c =$ 4500 Oe, ${}_BH_c = 3400$ Oe, $B_r = 4300$ Oe, $(BH)_{max} = 3.7$ MGOe

EXAMPLE 13. - BONDING BY IMMERSION IN A SALT BATH

A compact was prepared as described in Example 12, but the internal soldering was accomplished by immersing the sample for a period of two minutes in a bath of molten $SnCl_2$, kept at ~ 260° C. The magnet was substantially equivalent to the one of Example 12.

EXAMPLE 14. - BONDING BY IMMERSION IN LIQUID SOLDER

A compact was prepared as in Example 12, except that the compaction took place in air instead of hydrogen gas. The sample was then immersed for two minutes in a bath of molten 60/40 tin-lead solder at 300° C covered with $SnCl_2$ flux.

The magnet was completely coated with solder; microscopic inspection showed that good bonding had occurred in the interior. The magnetic properties were again substantially the same as in Example 12.

EXAMPLE 15. - PREPARATION OF MAGNET SAMPLES WITHOUT PRECOATING OF PARTICLES

A blend of three magnetic alloy powders in two different size factions was prepared from the following materials:

a) 22 grams of $MMCo_{3.25}Cu_{1.75}$
6 grams of $MMCo_3Cu_2$
28 grams (74–105 μm particle size)
b) 12 grams of $Sm\ Co_{3.5}\ Cu_{1.5}$ (less than 37 μm particle size)

b. 12 grams of $SmCo_{3.5}Cu_{1.5}$ (less than 37 μm particle size) The alloy powders were prepared and precipitation heat treated generally as set forth in Examples 1 and 2. None of the alloy powders were precoated or metallized.

The magnetic powder mixture was then intimately blended with (c) 4 grams of eutectic Sn-Pb solder powder of 10 to 20 μm particle size to give a weight ratio for a:b:c in the resulting blend of 7:3:1, or a binder content of about 9%. A portion of the blend was pressed into brick-shaped magnets of about 3/4 × 1/4 × 1/8 inch edge dimensions. The equipment, procedure and other conditions were like those described in Example 3.

EXAMPLE 16. - PREPARATION OF SOLDER BONDED MAGNET SAMPLES WITHOUT PRECOATING OF PARTICLES

Another portion of the blend of Example 15 was immersed into a soldering flux, specifically, a dilute solution of hydrochloric acid and tin chloride in methanol, then vacuum dried and pressed into brick-shaped magnets as in Example 15. The samples were then slowly preheated to approximately 150° C in air, kept at that temperature for a few minutes, and then immersed in a pool of molten solder at about 300° C for 2 minutes. Upon removal, the excess solder was shaken off and the samples allowed to cool. Then they were ground to have flat surfaces and well defined dimensions as required for the compressive strength tests.

EXAMPLE 17. - PREPARATION OF MAGNET FROM UNCOATED POWDER FRACTIONS OF TWO MAGNETIC MATERIALS WITH A SOLDER BINDER.

The following powders were used in the weight ratio $a:b:c: = 5:3:2$.

a. $MMCo_3Cu_2$, precipitation heat treated 3 hours at 500° C, particle size 74–105μm.

b. $SmCo_5$, 10–20 μm particle size, not precoated with metal.

c. Solder, 60%Sn/40%Pb, less than 10 μm particle size.

The magnetic powder fraction was briefly immersed in the liquid solder flux of Example 16, then vacuum dried. Magnetic and solder powder were thoroughly blended and then compacted as described in Example 3. The compact was then heated inside an evacuated quartz tube ($10^{-1}$Torr) to 280° C for 5 minutes. The resulting magnet had the following properties: ${}_MH_c =$ 4800 Oe, $B_r = 4200$ Oe, $(BH)_{max} = 3.3$ MGOe.

COMPARATIVE COMPRESSIVE STRENGTH TESTS

The tests were performed on a standard Instron Universal Tester equipped with automatic load pacer, load-cell recording system and an elevated-temperature sample chamber. Most samples were prepared as die-pressed "bricks" of the approximate dimensions ¾ × ¼ × ⅛ inches, with the compacting force applied parallel to the shortest dimension (⅛ inches) and the aligning field parallel to the medium (¼ inches) dimension. Some were then cut into three parts (¼ × ¼ × ⅛) for the use in the compressive strength tests. This allowed several tests on a given brick, such as application of the load parallel and perpendicular to the original pressing direction. The load was applied at a test rate of 0.05 inches/minute for all samples of Groups I through V.

The samples of Groups VI and VII were commercial Sm-Co sintered magnets in the shape of cylinders of ~¼ diameter and ~1/10 inches length. They were tested at a rate of about 0.002 inches/min on the same machine with the load parallel to the cylinder axis. The data for these are taken from a U.S. Air Force contract report. ("Research to Investigate the Aging Characteristics of Samarium-Cobalt Magnets", by H. F. Mildrum and K. J. Strnat, AFML-TR-74-50, Wright-Patterson AF Base, Ohio, March 1974).

Figure 3:
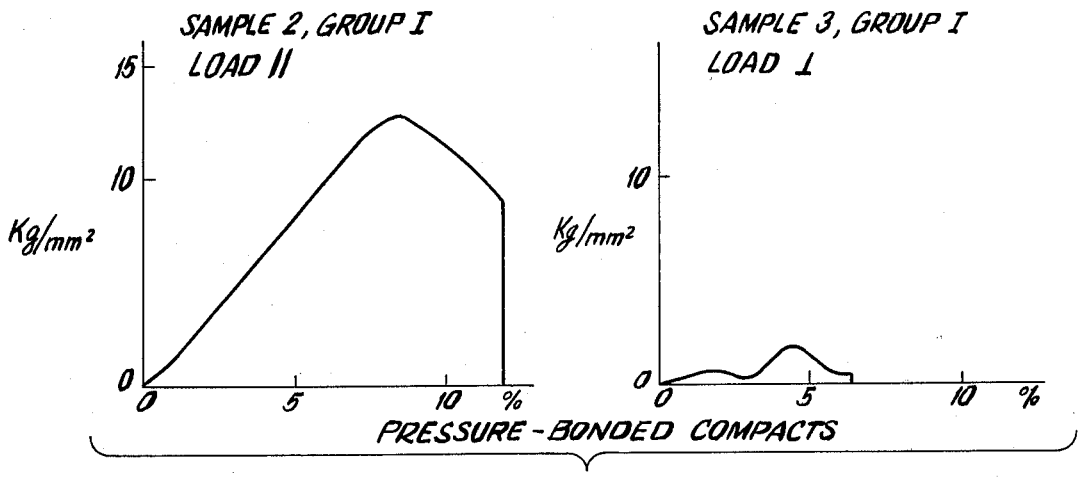
FIGS. 3, 4 and 5 shows stress-strain curves corresponding to several of the compressive strength tests of Table I.
Figure 4:
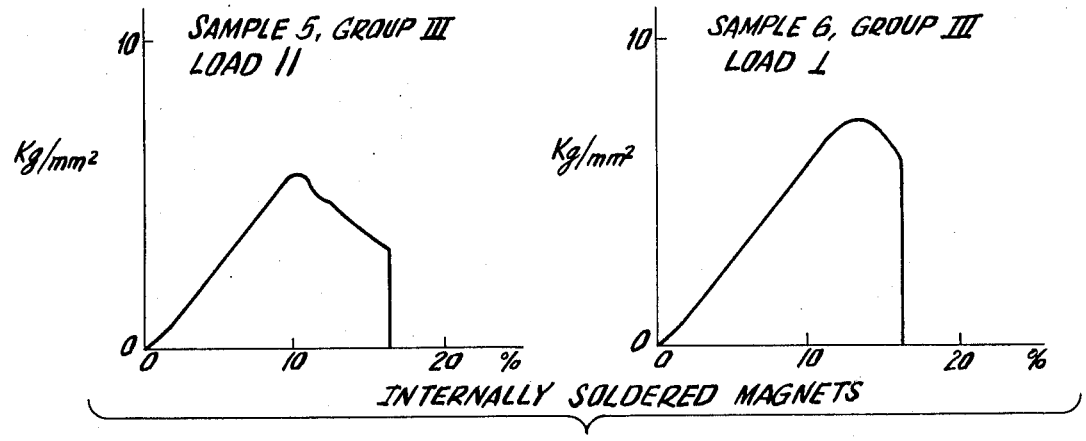
Figure 5:
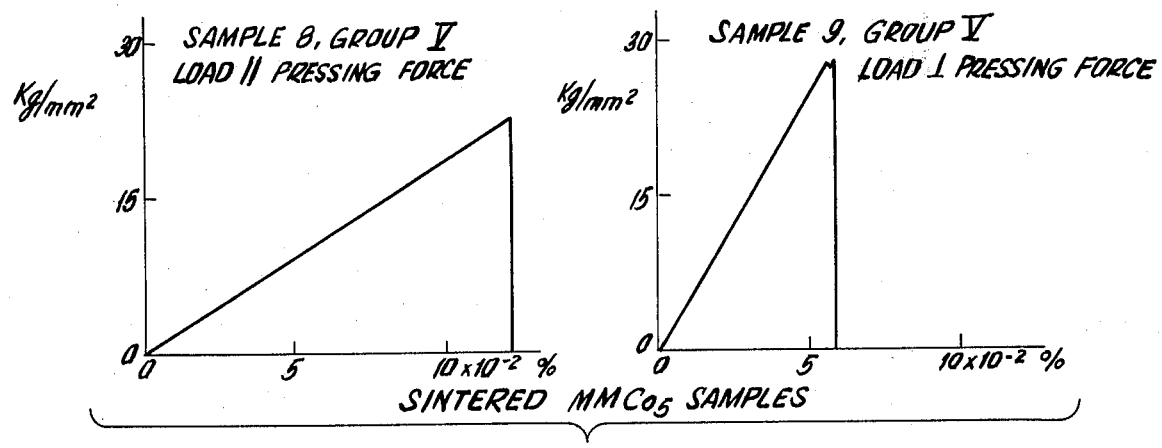

The results of all compression tests are summarized in Table I and in 3 figures showing stress-strain curves typical for the 3 basic types of magnets tested: FIG. 3 for a merely compression-bonded compact with Sn-Pb binder, FIG. 4 for an internally soldered magnet, and FIG. 5 for a sintered $MMCO_5$ sample (MM=Cerium-rich mischmetal). A review of these results allows the following conclusions to be drawn: All sintered magnets exhibit typical brittle behavior with the stress-strain curve rising linearly to the point at which fracture occurs. Under the influence of high internal magnetic forces, most sintered magnets then virtually explode into many tiny fragments. The ultimate compressive stress varies widely, from 24.8 to 106 kg/mm$^2$, which indicates that fracture is initiated by local stress risers, such as microcracks initially present in the magnets.

The bonded magnets, whether simply compacted or heated to melt the solder, behave as reasonably ductile materials. This is indicated by the nonlinear stress-strain curves (FIGS. 3 and 4) and the appearance of the fracture surfaces under the microscope. Fracture does not occur in the catastrophic manner observed on sintered magnets. Rather, after fracture, the merely compacted magnets appear as a crumbled mass of pieces holding together loosely, while those properly soldered are a flat, cracked, but coherent "cake". The ultimate strength is substantially lower than than of sintered magnets; it can, of course, be no greater than that of the soft binder matrix, less if no good bond between binder and magnetic particles is acheved.

It is noted that the unsoldered, merely-pressure compacts of Group I show a pronounced anisotropy of their compressive strength and length change. The respective values are 13 to 14 kg/mm$^2$ and nearly 12% when the test load is applied in the same direction as the uniaxial pressure was during compacting, but only 1.7 kg/mm$^2$ and 3.8% when the load is applied perpendicular to the pressing direction. After the compact is heated to achieve internal soldering, this undesirable anistropy disappears. The samples of Group III had a nearly direction-independent ultimate stress (5.7 and 7.2 kg/mm$^2$ respectively for the two load axes) and length change (16.1 and 16.5%). Sample 7, Group IV, had nearly the same ultimate stress (7 kg/mm$^2$) as Group III, although it was made from different magnetic components and had a different quantity of binder.

COMPARATIVE BALL-IMPACT STRENGTH TESTS

One of the most important practical differences between sintered, compression bonded and internally soldered magnets lies in their sensitivity to breaking or chipping on impact. Qualitative experiences show a high probability that a sintered Sm-Co magnet will shatter when dropped during normal handling, while a soldered magnet will almost certainly survive under the same circumstances. A non-heated compact with metal binder has fragile edges which crumble easily.

Quantitative information on this important property might be gained from standard pendulum-type impact tests, but samples of the shape and large size required for this were not available. A non-standard test was therefore improvised in which a steel ball of 19.1 mm diameter, weighing 28.3 g (1 oz) was dropped from different, increasing height through a vertical guide tube onto the center of a test sample. The sample, in most cases again a slab of about ¾ × ¼ × ⅛, was held flat on top of a large, 1 inch thick aluminum-alloy table by a mylar tape with adhesive on both sides.

Table II shows the results of these ball-drop tests in the form of a bar graph. The symbols used are: O - sample unharmed, V - just visible surface crack, N - no noticeable change, X - sample broke through. In all cases, the axes of magnetization, force applied during pressing, and impact force during test were the same, namely, through the thickness of the slabs (shortest sample dimension).

The results show that the sintered samples break most easily and that their impact strength covers again a considerable range. The resistance to breakage of the pressure-bonded compacts is equal to the best of the sintered magnets and quite uniform. Heating to effect internal soldering doubled the impact strength in 2 out of 3 cases, making these magnets far less sensitive to breakage during handling than either of the other two types. The third soldered sample was merely equal to the best of Groups I and III. Inspection showed that it did not lie flat on the table, but had a hollow spot under the impact point where a piece had spalled off during the immersion heat treatment, thus weakening the sample locally.

The Group designation in Table II has the same meaning as in Table I, except that in Group VII, samples 1 and 2 were from the Hitachi Magnetic Corp. in the shape of slabs 15.8 mm × 7.8mm × 3.2 mm thick (very similar to the samples of Group I and III.) Samples 3 through 6, of Group V were from Varian Associates and had the shape of ring segments about 15 to 20 mm × 7mm × 3.2mm thick.

Novel Characteristics of the Permanent Magnets

The magnets consist of at least one, preferably two magnetic powders or granulates, each of which is made from an alloy of the rare-earth cobalt family of hard magnetic alloys and of a binder which is a low-melting metal or solder alloy that forms a bond between the magnetic particles and serves as a soft matrix for them. The magnets are not brittle like most other high-grade permanent magnets but rather have considerable ductility. They can be shaped by pressing and conventional machining operations, and they can be joined to each other or to structural components by soft soldering using tin-lead alloys or other conventional solders.

TABLE 1

RESULTS OF COMPRESSIVE LOAD TESTS

| Sample Group | Try of sample, preparation method | Component powders [%] | composition | [μm] | Sample Group | Load or Pressing Force | Ultimate Stress [kg/mm$^2$] | Remarks | LengthChange to fracture [%] |
|---|---|---|---|---|---|---|---|---|---|
| | Compacts, pressure | 56 | $MMCo_{3.25}Cu_{1.75}$ | 74–177 | 1 | parallel | 13.9 | Ductile | 11.8 |
| I. | bonded (uniaxial). | 24 | $MMCo_{3.25}Cu_{1.75}$ | <37 | 2 | parallel | 13.1 | | 11.9 |
| | No flux, not heated | 20 | Eut. Sn/Pb solder | <10 | 3 | normal | 1.7 | fracture | 3.8 |
| | Compacts, pressure | 13.7 | $MMCo_3Cu_2$ | 74–105 | 4 | parallel | 6.1 | | 6.7 |
| II. | bonded (uniaxial) | 50 | $MMCo_{3.25}Cu_{1.75}$ | 74–105 | | | | Pieces | |

TABLE 1-continued

RESULTS OF COMPRESSIVE LOAD TESTS

| Sample Group | Try of sample, preparation method | Component powders [%] | composition | [μm] | Sample Group | Load or Pressing Force | Ultimate Stress [kg/mm²] | Remarks | LengthChange to fracture [%] |
|---|---|---|---|---|---|---|---|---|---|
| | No flux, not heated | 27.3 | $SmCo_{3.5}Cu_{1.5}$ | <37 | | | | | |
| | | 9 | Eut.Sn/Pb solder | 10–20 | | | | hang | |
| | Soldered compacts | | | | 5 | parallel | 5.7 | | 16.1 |
| III. | Uniax.pressure,flux | | Same as Group II | | | | | together | |
| | heated by immersion in liquid solder | | | | 6 | normal | 7.5 | | 16.5 |
| | Soldered compact | 56 | $SmCo_{3.5}CuFe_{0.5}$ | 74–105 | 7 | parallel | 7.0 | | 11.6 |
| IV. | Uniax.pressure,flux | 24 | $SmCo_5$ | <37 | | | | | |
| | heated in vacuum. | 20 | Eut.Sn/Pb solder | <10 | | | | | |
| | Sintered magnets, | 85 | $MMCo_5$ | 5–10 | 8 | parallel | 22.6 | | $12.2 \times 10^{-2}$ |
| V. | Diepressed | 15 | 60% Sm + 40% Co | | 9 | normal | 28.0 | Brittle | $5.8 \times 10^{-2}$ |
| | Sintered magnets, | | Sm-Co | | 10 | parallel | 62.4 | Fracture | — |
| VI. | commercial (Raytheon | | 2-phase alloy | | 11 | parallel | 40.0 | Magnets | — |
| | Comp.) diepressed | | single powder | | 12 | parallel | 54.0 | burst | — |
| | Sintered magnets, | | $SmCo_5$base metal, | | 13 | parallel | 38.8 | into | — |
| VII. | commercial (General | | Sm-rich Sm-Co | | 14 | parallel | 24.8 | many | — |
| | Electric Co.) | | sintering aid | | 15 | parallel | 106.0 | small | — |
| | isostatically pressed | | | | | | | slivers | |

TABLE II

RESULTS OF BALL-DROP IMPACT TESTS

| Sample Group | Type of Sample preparation method | Sample No. | 3 | 4 | 5 | 6 | 7 | 8 | 9 | 10 | 11 | 12 | 13 | 14 | 15 |
|---|---|---|---|---|---|---|---|---|---|---|---|---|---|---|---|
| | | | Drop Height | | | | | | | | | | | | |
| I. | Compacts, no flux | 1 | 0 | 0 | 0 | V | N | N | X | | | | | | |
| | not heated | 2 | 0 | 0 | 0 | 0 | X | | | | | | | | |
| | | 3 | 0 | 0 | 0 | 0 | 0 | X | | | | | | | |
| | | 4 | 0 | 0 | 0 | 0 | X | | | | | | | | |
| III. | Soldered Compacts | 1 | 0 | 0 | 0 | 0 | 0 | 0 | 0 | 0 | V | V | V | X | |
| | fluxed, heated by immersion in liquid | 2 | 0 | 0 | 0 | V | V | X | | | | | | | |
| | Sn-Pb solder | 3 | 0 | 0 | 0 | 0 | 0 | 0 | 0 | V | V | V | V | X | |
| VII. | Sintered Sm-Co | 1 | 0 | 0 | 0 | 0 | X | | | | | | | | |
| | magnets (Hitachi | 2 | 0 | 0 | 0 | 0 | X | | | | | | | | |
| | Magnetics Corp.) | | | | | | | | | | | | | | |
| | Sintered Sm-Co | 3 | 0 | 0 | X | | | | | | | | | | |
| | magnets (Varian | 4 | 0 | 0 | X | | | | | | | | | | |
| | Associates) | 5 | X | | | | | | | | | | | | |
| | | 6 | X | | | | | | | | | | | | |

0 = Sample unharmed
V = just visible surface crack
N = no noticeable change
X = sample broke through Tables III and IV compare the mechanical and magnetic properties of internally soldered R-Co magnets with those of commercially available bonded and sintered magnets. Tables III and IV demonstrate that the solder-bonding method of this invention alleviates certain mechanical property disadvantages encountered when magnets are made by sintering the R-Co alloys or by bonding them with organics. The Tables show that the soldered magnets have a unique combination of strength properties which constitutes a very useful and desirable compromise between the known extremes of sintered and organic-bonded magnets. However, it will be appreciated that it is difficult to express in a quantitative way certain salient features of the soldered magnets qualitatively discussed before.

It is not asserted that the invention achieves higher ultimate tensile or compressive strength than the sintered magnets have. The mechanical/physical property advantages which are, however, achieved are discussed in the following:

a. Comparison with sintered R-Co magnets: The extreme brittleness of these is avoided; therefore, the soldered magnets do not shatter easily on impact, they keep their edges better, and they generally do not chip as easily as sintered R-Co. However, the numbers for tensile or compressive strength, hardness, elastic moduli, etc., cannot reflect these differences. The simplest way of describing them quantitatively is some kind of "practical" non-standard impact test simulating the abuses typically encountered in the handling of the magnets. (See the ball-drop tests described above.)

Extensive compressive-load tests on commercial sintered R-Co magnets have revealed that their mechanical strength values cover an extremely broad range. This behavior is typical of brittle materials in general, as is well known from other intermetallic compounds, glasses and ceramics. Grinding and rebonding the brittle materials with solder produces a product of very uniform and predictable mechanical strength. However, the strength is determined by the properties of the binder and the quality of the bond.

b. Comparison with organic-bonded magnets: While bonding of R-Co with rubber or plastics also removes the brittleness problems and yields magnets with uniform properties, organic bonded magnets are mechanically much weaker than the inventive soldered magnets (by about a factor 10 in ultimate tensile stress) and they have generally quite different mechanical behavior. While rubber-bonded magnets are flexible and elastic, solder-bonded ones are ductile, yet rigid. The metal binder also gives a higher service temperature (180° C for Sn-Pb solder, higher for other solders) than the various polymers (60 to 130° C).

Generally it must be said that very little quantitative information on the mechanical properties of permanent magnets can be found in the technical literature, even for types which have been in commercial production for decades. To illustrate this point, attention is directed to pages 872 and 873 of the standard reference book by R. M. Bozorth, "Ferromagnetism", Van Nostrand Company, 1955. General statements, such as "hard", "brittle", "ductile", "strong", or "weak" are the rule.

TABLE III

MECHANICAL PROPERTIES OF INTERNALLY SOLDERED R-Co MAGNETS COMPARED TO THOSE OF COMMERCIAL BONDED AND SINTERED MAGNETS

| Physical Property | Magnet Type | Internally[1] (Sn-Pb)Soldered Magnets | Sintered[2] R-Co Magnets | Plastic[3] bonded R-Co | Sintered barium ferrite | Rubber[4] bonded ferrite | Fe-Co[5] (Pb-matrix) ESD magnets |
|---|---|---|---|---|---|---|---|
| Ultimate tensile strength | kgf/mm² | 3.0* | 3.4* | <0.2* | 2–10 | 0.15–0.4 | 0.7–6.5 |
| Elongation to fracture | % | 5.3* | n.d. | n.d. | n.d. | 20 | n.d. |
| Ultimate compressive stress | kgf/mm² | 5.7–7.5 | 22–106 | n.d. | 70 | n.d. | n.d. |
| Length change to fracture | % | 11.6–16.5 | 0.06–0.12 | n.d. | n.d. | n.d. | n.d. |
| Density | g/cm³ | 7.0–8.5 | 7.3–8.5 | 5.2* | 4.8–5 | 3.7 | 9.2–10.3 |
| Melting or softening temperature of matrix | °C | ~190 | — | 60–140 | — | ~130 | 325 |
| Some general mechanical characteristics | — | ductile rigid | very brittle hard | soft rigid | brittle hard | elastic flexible | ductile rigid |

*Measured on single sample, or single published data point.
n.d. No data available
[1]Magnets according to invention, made as in example 11.
[2]Sm-Co based-Raytheon Comp. Hitachi Magnetics, Varian Assoc.
[3]Sm-Co based-Mitsubishi Steel Manufacturing Co.
[4]Plastiform - 3MCompany. Rubber magnet-Hitachi
[5]Lodex-Hitachi Magnetics Corp.

TABLE IV

MAGNETIC PROPERTIES OF INTERNALLY SOLDERED R-Co MAGNETS COMPARED TO THOSE OF COMMERCIAL ORGANIC OR METAL BONDED MAGNETS

| | | Internally[1] (Sn-Pb)Soldered Magnets | Plastic[2] bonded R-Co | Rubber[3] bonded ferrite | Fe-Co[4] (Pb matrix) ESD magnets |
|---|---|---|---|---|---|
| Energy product | [MGOe] | 3–4.6 | 6.9 | 0.3–1.4 | 1.3–3.4 |
| Intrinsic coercive force | [Oe] | 2400–6890 | 7500 | 1200–2700 | |
| Residual induction | [G] | 4200–4620 | 5500 | 1200–2400 | 2700–8000 |
| Normal coercive force | [Oe] | 2000–3940 | 5000 | 1000–1800 | 710–1250 |
| Service temperature limit | [°C] | ~180 | 60–100 | ~130 | ~150 |

[1]Magnets according to invention, examples 10–17
[2]Sm-Co based - Hera/Magnetic Polymers Ltd. (1974)
[3]Plastiform - 3M Company
[4]Lodex-Hitachi Magnetics Corp.

It is seen from the foregoing examples and tests that the present invention provides magnets which do not show the extreme brittleness of the sintered magnets, which can be precisely molded and easily machined, additionally, they exhibit better mechanical strength, shape retention under load and a better temperature stability than magnets made with organic binders. Further, the magnets magnetic properties, especially local remanence, coercive force and hysteresis loop shape are uniform through their entire volume.

It is noted that where cross reference has been made to related patent applications, the intention is to herein incorporate by reference the subject matter of the aforenoted patent applications. Similarly, the subject matter of U.S. Pat. No. 3,677,947 to Ray and Strnat is incorporated herein by reference.

What is claimed is:

1. A permanent magnet exhibiting pronounced ductility and mechanical strength superior to that of plastic or rubber-bonded magnets which is formed from compacted particles of at least one magnetic powder, said powder being a cobalt rare-earth alloy comprising:

a. a first component of from about 10 to 25 atomic % of at least one rare-earth selected from the group consisting of Y, Sc, La, Ce, Pr, Nd, Sm, Eu, Gd, Tb, Dy, Ho, Er, Tm, Yb, and Lu;

b. a second component of from about 75 to 90 atomic % of cobalt alone or in mixture with one or several metals selected from the group consisting of Cu, Fe, Mn and Ni, said cobalt being present in an amount of from 50 to 100% of said second component;

c. said particles being internally soldered by a third component of at least about 9% to 25% by weight of said first component and said second component of a metallic solder selected from the group consisting of tin-lead solders, tin, lead, tin modified by silver, antimony or indium; lead modified by tin, silver, antimony or indium; indium-rich solders and Wood's metal, said metallic solder having a melting point below 400° C.

2. The permanent magnet of claim 1, wherein said first component is a Ce-rich mischmetal.

3. The permanent magnet of claim 1, wherein said first component is Ce.

4. The permanent magnet of claim 1, wherein said first component is Sm.

5. The permanent magnet of claim 1, wherein said second component is free of Cu and has a particle size between about 1 and 50 μm.

6. The permanent magnet of claim 1, wherein said second component includes Cu and has a particle size in the range of about 20 to 250 μm.

7. The permanent magnet of claim 1, wherein at least one of said first and second components is coated with tin or zinc.

8. A method of producing a permanent magnet, which comprises:

a. mixing a magnetic powder consisting essentially of cobalt-rare-earth-based alloy particles with at least about 9 to 25 percent by weight of a metallic particulate solder having a melting point below 400° C and selected from the group consisting of tin-lead solders, tin, lead, tin modified by silver, antimony or indium, lead modified by tin, silver, antimony or indium, indium-rich solders and Wood's metal;

b. introducing the powder mixture of (a) into a mold and compacting it therein;

c. heating the compact thus obtained to a temperature above the melting range of the solder whereby internal soldering of the particles of the compact takes place; and d. cooling the product thus obtained.

9. A method as claimed in claim 8, wherein the mixture of step (a) is introduced into said mold with low packing density, whereafter and prior to the compacting of step (b) the magnetic particles of the powder are oriented by the application of a magnetic field.

10. A method as claimed in claim 8, wherein said magnetic powder contains a plurality of fractions of cobalt-rare-earth alloy powder of different particle size but with a narrow size distribution within each fraction.

11. A method as claimed in claim 10, wherein the individual fractions of the cobalt-rare earth alloy powder have different chemical compositions.

12. A method as claimed in claim 9, wherein the mixture of step (a) is premagnetized before being introduced into said mold, said premagnetizing being effected in a magnetic field exceeding the coercive force of the magnetically hardest component of the mixture.

13. A method as claimed in claim 8, wherein the metallic solder is a eutectic or almost eutectic lead-tin solder.

14. A method as claimed in claim 8, wherein, prior to the heating of step (c), a flux material, in solid, liquid or gaseous form, is added to the mixture or compact.

15. A method as claimed in claim 14, wherein the flux material is hydrogen or hydrogen-chloride gas.

16. A method as claimed in claim 8, wherein the cobalt-rare-earth-based alloy of which the magnetic particles are made also contains at least one of the metals: manganese, iron, nickel and copper.

17. A method for the production of permanent magnets from cobalt-rare earth alloys which is characterized by the following sequence of steps:

a. mixing the powdered cobalt-rare earth based alloys with about 9 to 25 weight percent of a pulverized solder having a melting point below 400° C and selected from the group consisting of tin-lead solders, tin, lead, tin modified by silver, antimony or indium, lead modified by tin, silver, antimony or indium, indium-rich solders and Wood's metal, and with a flux material;

b. introducing the powder mixture into a pressing mold while retaining it in lowest possible packing density;

c. orienting the particles by application of a magnetic field of proper strength if production of an anisotropic magnet is desired;

d. compacting the mixture by pressing; and e. heating the powder compact to a temperature above the melting range of the solder to effect internal soldering and subsequently cooling the product thus obtained to room temperature.

18. A method as claimed in claim 8, wherein said particles (a) are coated with tin or zinc.

* * * * *

UNITED STATES PATENT OFFICE

CERTIFICATE OF CORRECTION

Patent No. 3,998,669 Dated December 21, 1976

Inventor(s) Karl Strnat

It is certified that error appears in the above-identified patent and that said Letters Patent are hereby corrected as shown below:

Column 23, Line 2, after "and" insert --the alloy--;

Line 5, after "and" insert --the alloy--;

Line 7, change "claim 1" to --claim 5-- and delete "at least";

Line 8, delete "one of said first and second components" and insert --the alloy-- therefor.

Signed and Sealed this

*twenty-third* Day of *August 1977*

[SEAL]

*Attest:*

RUTH C. MASON
*Attesting Officer*

C. MARSHALL DANN
*Commissioner of Patents and Trademarks*